US005097763A

United States Patent [19]

Simeth

[11] Patent Number: 5,097,763

[45] Date of Patent: Mar. 24, 1992

[54] PLATE CYLINDER ARRANGEMENT FOR A PRINTING PRESS

[75] Inventor: Claus Simeth, Offenbach am Main, Fed. Rep. of Germany

[73] Assignee: Man Miller Druckmaschinen GmbH, Geisenheim, Fed. Rep. of Germany

[21] Appl. No.: 607,117

[22] Filed: Nov. 2, 1990

[30] Foreign Application Priority Data

Nov. 2, 1989 [DE] Fed. Rep. of Germany ..... 3936446

[51] Int. Cl.[5] ..... B41F 27/12

[52] U.S. Cl. ..... 101/382.1; 101/415.1; 101/388; 101/DIG. 36; 33/614; 33/617; 33/621

[58] Field of Search ..... 101/415.1, 382.1, 383, 101/385, 386, 387, 388, DIG. 36; 33/614, 617, 618, 619, 620, 621

[56] References Cited

U.S. PATENT DOCUMENTS

| | | | |
|---|---|---|---|
| 2,056,205 | 10/1936 | O'Hara | 101/415.1 |
| 2,309,161 | 1/1943 | Breman | 101/415.1 |
| 3,020,842 | 2/1962 | Neal | 101/415.1 |
| 3,154,012 | 10/1964 | Fischer | 101/DIG. 36 X |
| 3,625,151 | 12/1971 | Hart | 101/415.1 |
| 3,858,512 | 1/1975 | Simeth | 101/415.1 |
| 4,596,188 | 6/1986 | Bonomi | 101/415.1 |
| 4,603,641 | 8/1986 | Jeschke | 101/415.1 |
| 4,712,475 | 12/1987 | Jeschke | 101/415.1 |
| 4,724,762 | 2/1988 | Jeschke | 101/415.1 |
| 4,730,557 | 3/1988 | Wieland | 101/415.1 |
| 4,831,931 | 5/1989 | Jeschke | 101/415.1 |
| 4,862,800 | 9/1989 | Wieland | 101/415.1 |
| 4,893,561 | 1/1990 | Grosshauser | 101/382.1 |
| 4,938,135 | 7/1990 | Wieland | 101/415.1 |

FOREIGN PATENT DOCUMENTS

| | | | |
|---|---|---|---|
| 154843 | 3/1984 | European Pat. Off. | 101/415.1 |
| 2431133 | 1/1976 | Fed. Rep. of Germany | 101/415.1 |
| 2713994 | 10/1978 | Fed. Rep. of Germany . | |
| 3633855 | 4/1988 | Fed. Rep. of Germany . | |
| 3731642 | 3/1989 | Fed. Rep. of Germany . | |
| 1284695 | 4/1971 | United Kingdom | 101/415.1 |

*Primary Examiner*—Edgar S. Burr
*Assistant Examiner*—Eric P. Raciti
*Attorney, Agent, or Firm*—Spencer & Frank

[57] ABSTRACT

Disclosed is an apparatus for a printing press, with means being provided in the press for correcting any out-of-register position of a printing plate, so as to release, after the printing plate has been clamped onto the plate cylinder, initially the tension of a rear tensioning strip, whereupon a forward tensioning strip is canted by a desired degree. Then, rear stops are moved back and the rear tensioning strip is tensioned by way of spring force. The described steps are repeated if required. Means are also proposed to noticeably reduce the sliding friction between the plate cylinder and the printing plate.

6 Claims, 5 Drawing Sheets

PLATE CYLINDER ARRANGEMENT FOR A PRINTING PRESS

BACKGROUND OF THE INVENTION

1. Field of the Invention

This invention relates to a plate cylinder for a printing press including a forward and a rearward tensioning rail equipped with tensioning elements for tensioning a printing plate in contact with the circumference of the plate cylinder at the beginning and end of printing, with the tensioning rails being disposed in a trough extending axially along the circumference of the plate cylinder and having a forward and a rearward trough wall.

2. Description of the Prior Art

During printing on a printing press, the problem may arise that the printed image of one color is canted or tilted so to speak, relative to the printed image of another color. This canting must of course be eliminated to prevent the printed sheets from being wasted paper.

For this purpose it is known to unilaterally displace the axis of the respective plate cylinder. However, this only inaccurately compensates for the respective printing unit being out of register.

For the same purpose it is also known to offset the tensioning rails axially. However, this is complicated from a structural point of view and the friction between the actual plate cylinder and the printing plate must be overcome. In this connection, it should be brought to mind that a printing plate cannot be stressed with forces of any desired magnitude because it would be unduly deformed.

SUMMARY OF THE INVENTION

It is an object of the present invention to provide a printing press plate cylinder which has the above-mentioned features and with which it is possible by structurally simple means to bring the respective color back into registration very quickly, possibly even with the press running, thus avoiding the described drawbacks.

The above and other objects are accomplished in the context of a plate cylinder for a printing press as first described above, where adjustment means are provided between the two tensioning rails for displacing the two tensioning rails against spring forces in the circumferential direction of the plate cylinder toward the exterior of the trough, with the forward tensioning rail being separately adjustable at both its ends while the rear tensioning rail is adjustable in a direction parallel to itself.

These measures make it possible, once an undue color deviation has been noted for the respective color run, and thus the printing plate is already clamped onto the cylinder, to initially release the tension on the rear tensioning rail. This results in a displacement of the rear tensioning rail parallel to itself or essentially parallel to itself in the direction of the rear trough wall. Thus, there is enough room for the forward tensioning rail to be subsequently canted to such a degree that the respective faulty alignment is compensated or at least compensated, as much as possible. Then, the stops for the rear tensioning rail are moved back again so that the springs of the rear tensioning rail are able to tension it to the desired degree. If these measures are not yet sufficient to completely correct the error, the measures are repeated once more in the described sequence.

For a manual displacement, it will generally be enough to perform a single series of these measures, while for a motor driven adjustment by way of sensors, which can then also be performed with the machine running, the described process steps are generally smaller and must therefore be performed several times in succession until the error has completely disappeared.

Particularly for the mentioned correction by means of a motor, it is preferred if at least one pressure sensor is provided which measures the force between the plate cylinder and the rear tensioning rail. The pressure sensor will generally be disposed at the means for displacing the rear tensioning rail or also at the rail itself. It serves to test the form lock between the adjustment means and the rear tensioning rail or the component connected with it. Consequently, the adjustment motor performs the corresponding steps for the displacement of the rear tensioning rail.

It has already been pointed out that in the prior art a very high friction force exists between the upper face of the actual plate cylinder and the underside of the printing plate which, in the prior art, makes an effective correction of the register noticeably more difficult, particularly since only limited forces can be exerted on the printing plate, otherwise it suffers undue deformation. Although it is known to dispose a support sheet of oiled paper or similar thin sheets between the cylinder and the printing plate, this does not noticeably reduce the friction force because the relatively rough surfaces of the oiled paper still rest on the likewise rough faces of the plate cylinder and of the printing plate.

In this connection, one feature of the invention is to dispose at least two thin sheets between the upper face of the plate cylinder and the underside of the printing plate. The surfaces of these thin sheets have different coefficients of sliding friction, with the faces having the good sliding properties lying against one another. This quite considerably reduces the sliding friction between the actual plate cylinder and the printing plate, and the desired adjustment into registration by the means according to the invention is noticeably facilitated and made more precise. The two thin sheets slide against one another on their easily sliding faces. Their rougher faces lie against the plate cylinder and against the printing plate, respectively.

When the term thin sheet is employed above and hereinafter, it is intended to include any thin, sheet-like, flexible structures, for example those made of paper, cardboard, plastic and the like. The only thing significant in this connection is that one face of the thin sheets has a low coefficient of sliding friction. Such thin sheets may, for example, be coated on one face with plastic, with the coated face then having the desired, good sliding characteristics.

The pivoting of the forward tensioning rail is transferred by way of the printing plate correspondingly also to the rear tensioning rail. Therefore, the latter must be able to move laterally, approximately on a circular arc. However, the tensioning rails are guided in their adjustment direction, that is, in the circumferential direction. This guidance for the rear tensioning rail must now be configured, according to the invention, so that the guidance in the adjustment direction remains in effect but nevertheless lateral pivoting, that is, displacement essentially in the axial direction of the plate cylinder, is possible.

To solve this problem, a further aspect of the invention is to provide a guide for the rear tensioning rail which guides it in its adjustment direction and which also permits, by way of a rubber elastic element, a displacement of the rear tensioning rail in the axial direction. The rubber elastic element ensures a sufficiently long guidance in the displacement direction of the rear tensioning rail and simultaneously permits pivoting of the rear tensioning rail about the relatively short pivot path.

A preferred embodiment for this purpose provides that a guide screw is screwed into the rear tensioning rail and has a shank guided in a guide recess in the trough, with the rubber elastic element being placed onto the screw shank. If the forward tensioning rail is pivoted, the rubber element is correspondingly compressed when it contacts the right or left wall of the recess and thus the desired compensation and the required lateral displacement of the rear tensioning rail is made possible while its guidance in the displacement direction, that is, in the circumferential direction, is retained. At the same time, this rubber guide serves to center the rear tensioning rail.

The above and other objects, effects features and advantages of the present invention will become more apparent from the following description of embodiments thereof taken in conjunction with the accompanying drawings.

DETAILED DESCRIPTION OF THE PREFERRED EMBODIMENTS

Figure 2:
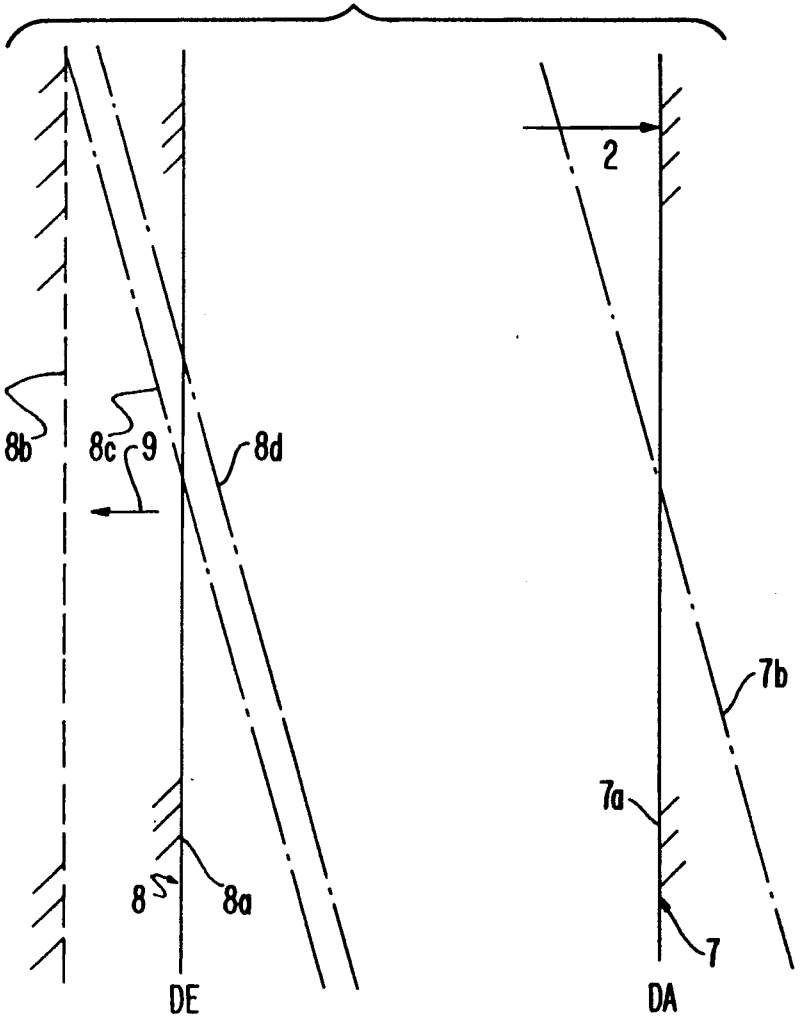
FIG. 2 is a schematic top view corresponding to FIG. 1 to explain the basic embodiment according to the present invention.

Initially the problem on which the invention is based will be described with reference to FIG. 1. Solid lines indicate a printed image 1 of a certain color unit in a printing press, possibly a multi-color printing press. Black triangular markers 2 at the corners of printed image 1 indicate a correct position of printed image 1 in the printing press. Corresponding markers 4 of further color units must thus coincide with markers 2. These markers 2 thus define so to speak the zero position.

If the printer now determines that a corresponding printed image of another color unit indicated by dashed lines 3 is turned or canted relative to printed image 1, that is, to the zero position, so that corresponding markers 4 of the canted printed image no longer coincide with markers 2 of the correct printed image, suitable measures must be taken to get markers 2 and 4 to coincide again as soon as possible. FIG. 1 also indicates that the canting of printed image 3 in this example can be imagined as a rotation of printed image 3 about a point 5. Corresponding markers 4 thus indicate the rotated position which must be corrected.

In connection with the description of the figures it should also be noted that a plate cylinder 27 (see FIG. 3) and its printing plate rotate in the direction of arrow 6 so that location DA marks the beginning of printing and location DE the end of printing.

The principle of correcting the misprint described in FIG. 1 in connection with the plate cylinder according to the invention will now be described with reference to FIG. 2.

Figure 1:
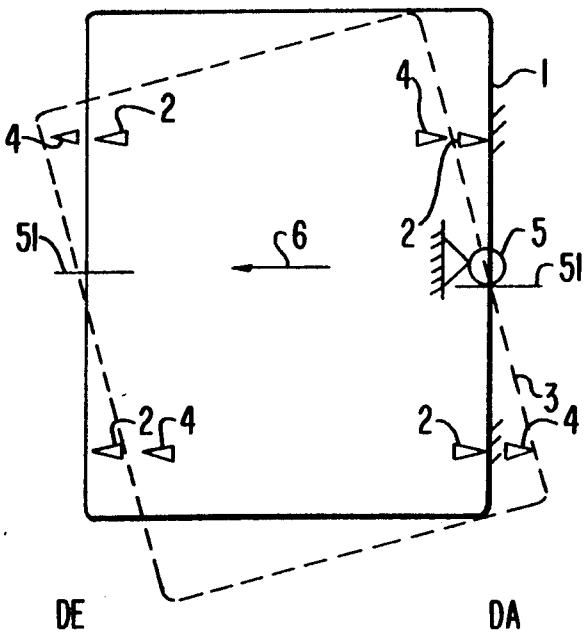
FIG. 1 is a schematic top view to explain the problem on which the invention is based.
Figure 3:
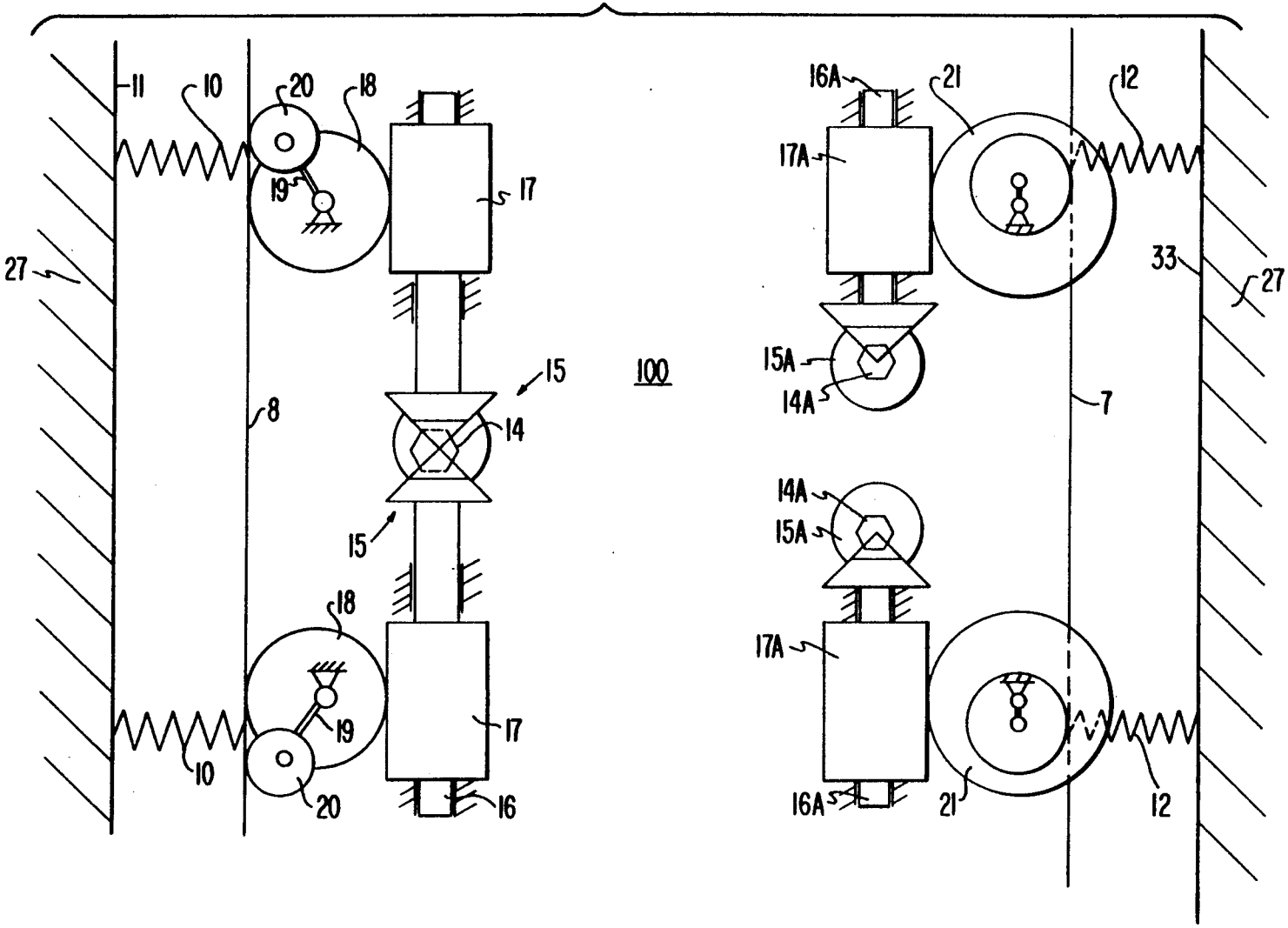
FIG. 3 is a top view of a first embodiment of the invention in which plate tension is set manually.

In the starting position, in which the printer notes the misprint on a printed sheet as shown in FIG. 1, the printing plate is clamped onto the cylinder at a forward tensioning rail 7 at its start-of-printing location and at a rear (rearward) tensioning rail 8 at its end-of-printing location as schematically shown in FIG. 2.—; after "." insert—Both tensioning rails and associated rail adjustment mechanism to be described are disposed in a trough 100, extending axially along the circumference of plate cylinder 27, and being formed by a rear trough wall 11 and a forward trough wall 33 as shown in FIG. 3. In order to straighten out this misprint and the out-of-registration position, respectively, the printing plate tension is initially released.

When the error in register is noted, the printing plate is tensioned at positions 7*a*, 8*a* of tensioning rails 7 and 8, respectively. Now the adjustment process begins. Initially, rear tensioning rail 8 in FIG. 2 is moved to the left, that is, in the direction of an arrow 9. It then takes on the position indicated at 8*b*.

Now forward tensioninq rail 7 is shifted or turned, respectively, so that the register error is compensated. As an example, FIG. 2 shows that, in order to accomplish this, forward tensioning rail 7 takes on a position 7*b* which is turned relative to the starting position.

Because rear tensioning rail 8 is not under tension, it is able to follow this displacement or rotation, respectively. It therefore takes on the indicated position 8*c* which is also rotated or canted and is more or less parallel to position 7*b*.

In a last process step, the printing plate is tensioned again. For this purpose, rear stops (see rollers 20 in FIG. 3), which in FIG. 2 contact rear tensioning rail 8 from the right, are merely returned to the center, thus releasing rear tensioning rail 8. Springs 10, which lie against rear tensioning rail 8 between rear trough wall 11 and rear tensioning rail 8 press rear tensioning rail 8 to the right in FIG. 2 into a tensioned position indicated at position 8*d*, thus tensioning the printing plate.

Due to friction along the circumference of the printing plate, the tensioned end positions of tensioning rails 7 and 8 need not be parallel to one another.

In this tensioned end position, there will generally be some air between rear stops 20 of rear tensioning rail 8 and rear tensioning rail 8 because the latter is tensioned by springs 10.

A set of springs 12 is also disposed between forward trough wall 33 and forward tensioning rail 7 to press forward tensioning rail 7 in the direction of arrow 9 toward the center of the trough.

A structural solution for manually tensioning the plate is shown in FIG. 3. Here, springs 10 are indicated between rear trough wall 11 and rear tensioning rail 8, as well as springs 12 between forward trough wall 33 and forward tensioning rail 7.

Rear tensioning rail 8 is displaced parallel to itself. In this connection, FIG. 3 shows a manually actuated screw 14 whose rotation is transferred by way of a gear 15 to the rotation of a threaded rod 16. The latter is provided with thread sections 17 which mesh with worm gears 18 to which levers 19 are fixed and which at their ends bear on rollers 20.

Rollers 20 lie against the inside of rear tensioning rail 8.

If one turns screw 14 by means of a suitable key in one or the other direction of rotation, levers 19 are thereby pivoted about the same angle in opposite directions, and thus rear tensioning rail 8 is displaced parallel to itself.

Forward tensioning rail 7, however, can be displaced separately at both its ends so that, as described above in connection with FIG. 2, it can be canted. For this purpose, drive mechanisms including adjustment screws 14*a*, gears 15*a*, threaded rods 16*a* equipped with thread sections 17*a*, just as described above with respect to the rear tensioning rail, also employed to adjust forward tensioning rail 7, but here at the right and left end of forward tensioning rail 7. The pivot angle of threaded rods 16*a* may additionally be detected by way of a potentiometer (not shown) or the like for the purpose of indicating the pivot angle.

Rotation of threaded rods 16*a* produces, by way of eccentric wheels 21, a corresponding displacement of forward tensioning rail 7. Alternatively, eccentric wheels 21 may be replaced by lever mechanisms corresponding to levers 19 and rollers 20 shown on the left in FIG. 3 in connection with rear rail 8.

Thus, the right and left ends of forward tensioning rail 7 can be adjusted individually. The pivot angle may be displayed in a suitable manner separately for the right and left, for example by way of a digital display (not shown) which is preferably supplied with current from a battery.

With reference to FIG. 3, initially tensioned plate cylinder 27 is thus released by a parallel displacement of rear tensioning rail 8 to the left in FIG. 3 exactly as described as above in connection with FIG. 2. Then, forward tensioning rail 7 is canted by suitably turning two screws 14A. In a third process step, stops 20 for rear tensioning rail 8 are moved back toward the center of trough 100 so that rear springs 10 are able to urge rear tensioning rail 8 into a tensioned position which it automatically takes up because the rear stops (rollers 20) maintain a sufficient distance from rear tensioning rail 8.

Figure 4:
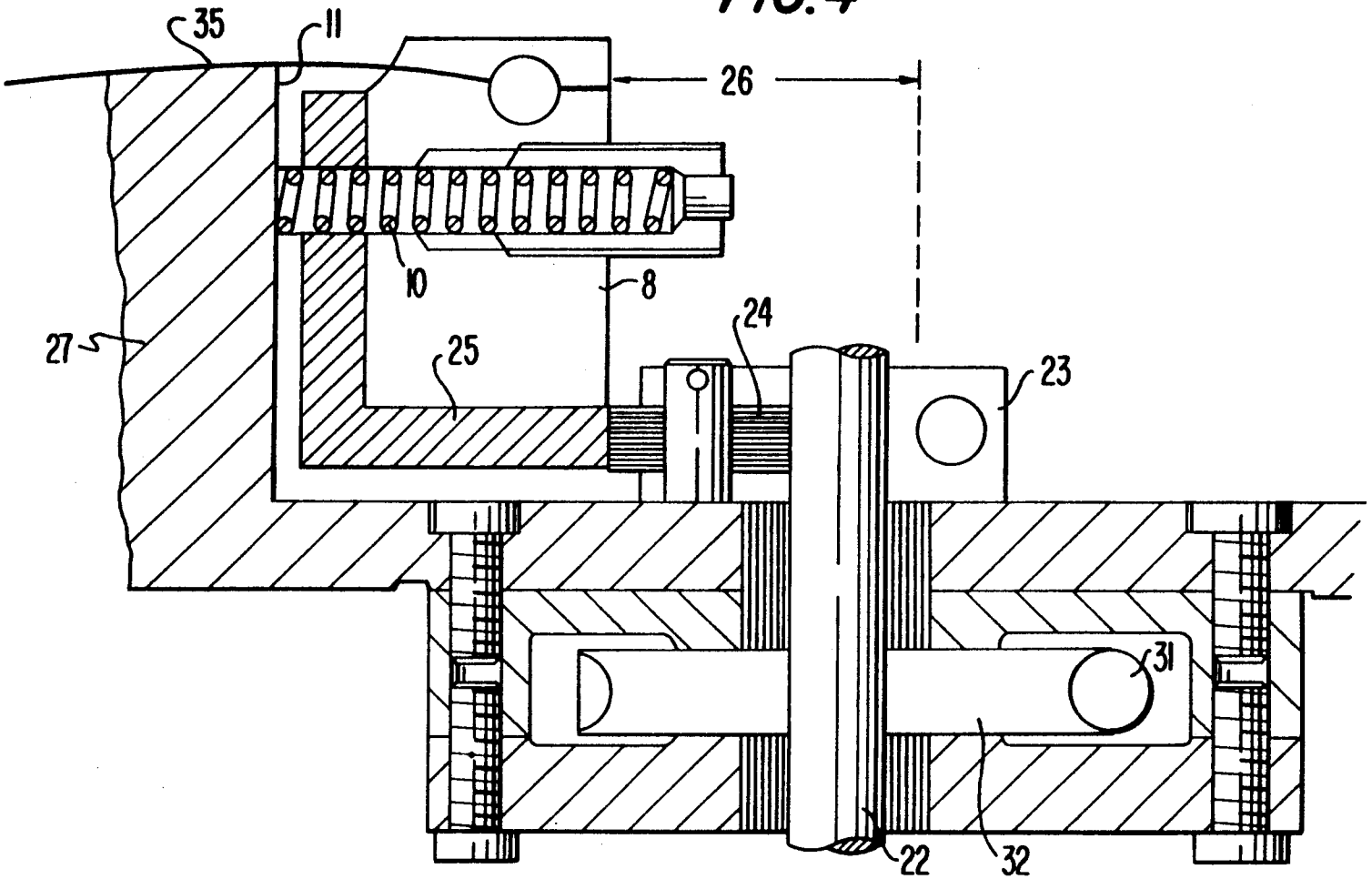
FIG. 4 is an axial sectional view of an embodiment of the rear tensioning rail including means for adjusting it by way of a motor.

FIG. 4 shows an embodiment for a motor driven adjustment of rear tensioning rail 8. For this purpose, a motor driven worm 31 is provided which by way of a worm gear 32, turns a shaft 22 on which is fixed a tensioning lever 23. The latter has a roller 24 which is in contact with the rear end of rear tensioning rail 8. The components described so far in connection with FIG. 4 correspond in principle to the respective structure of FIG. 3. Worm 31 can also be rotated manually.

In FIG. 4, rear tensioning rail 8 is made of several parts. It is composed of an L-shaped basic rail or slide rail 25 along which the here two-part rear tensioning rail 8 is able to slide in the axial direction, that is, in a direction perpendicular to the plane of the paper of FIG. 4.

FIG. 4 also shows the manner in which the end-of-printing location of printing plate 35 is clamped in. Additionally it is shown structurally how spring 10 is inserted into rear tensioning rail 8 and can have its tension adjusted. The adjustment path of rear tensioning rail 8 is indicated at position 26.

A pressure sensor may be provided at tensioning lever 23 or at roller 24 or also at rear tensioning rail 8 to check the form lock between roller 24 and tensioning rail 8 or base rail 25, respectively. This results in the stepping circuit for the drive motor which drives worm 31.

Figure 5:
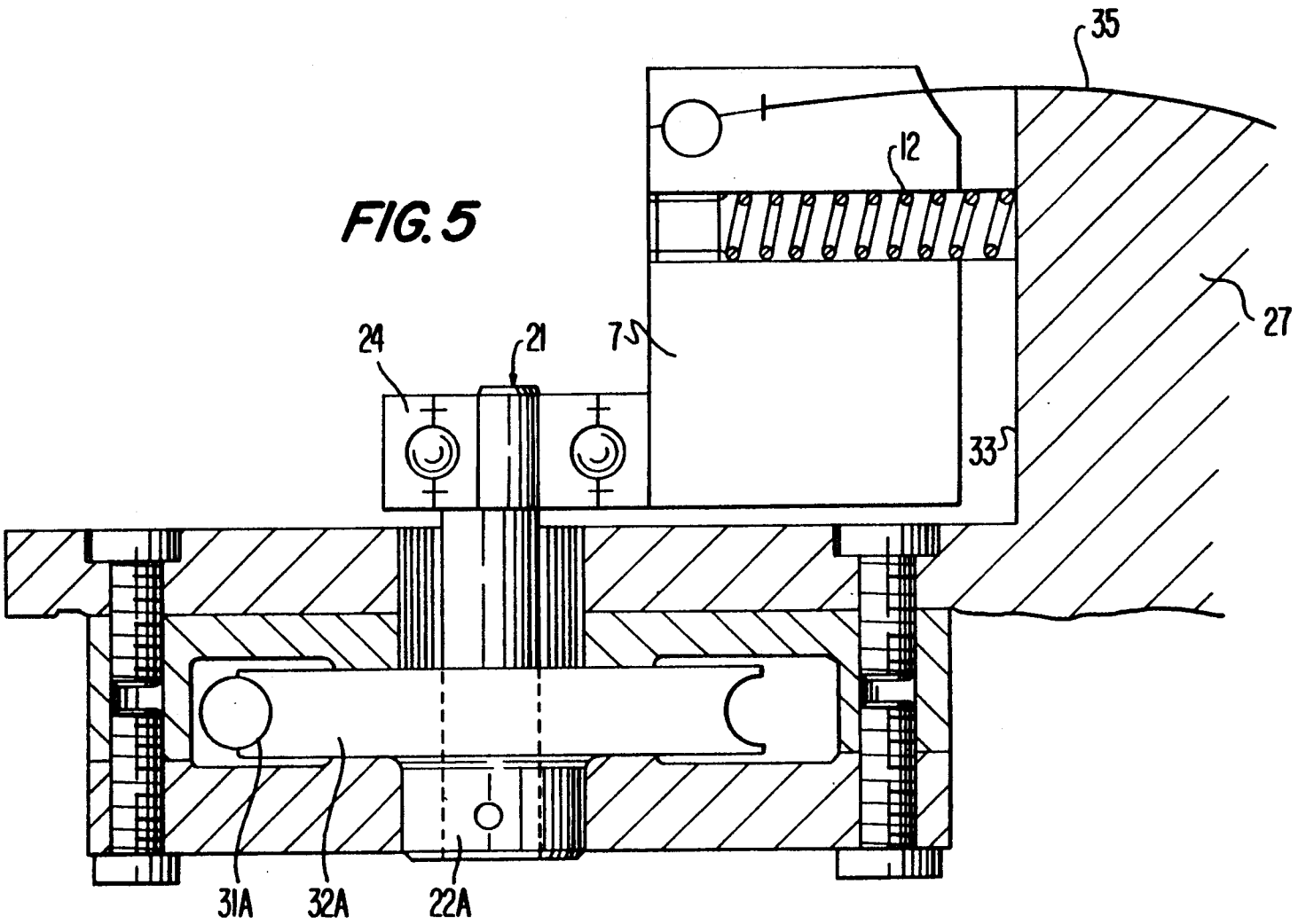
FIG. 5 is an axial sectional view of an embodiment of the forward tensioning rail including means for adjusting it by way of a motor.

FIG. 5 shows an embodiment for the motor driven adjustment of forward tensioning rail 7. Here again, with respect to the basic structure, reference is made to the right-hand portion of FIG. 3. FIG. 5 shows only one of two possible adjustments for forward tensioning rail 7. In FIG. 5 as well, a worm 31A is turned manually or by a motor (not shown). It meshes with a worm gear 32A of shaft 22A, thus turning an eccentric wheel 21 which, in turn, causes a desired adjustment of forward tensioning rail 7.

FIG. 5 also shows plate cylinder 27. Here it is desired to make a fine adjustment corresponding, for example, to an adjustment path of 3 mm for a rotation of about 90°.

It is of particular importance that the invention makes it possible to omit an otherwise required circumferential registration.

This circumferential register brings the printed image of the respective printing plate circumferentially into the registration of the printing press. In the prior art this requires complicated drive mechanism measures. This adjustment of the printing plate in the circumferential direction is accomplished by the adjustment mechanism according to the invention.

Figure 6:
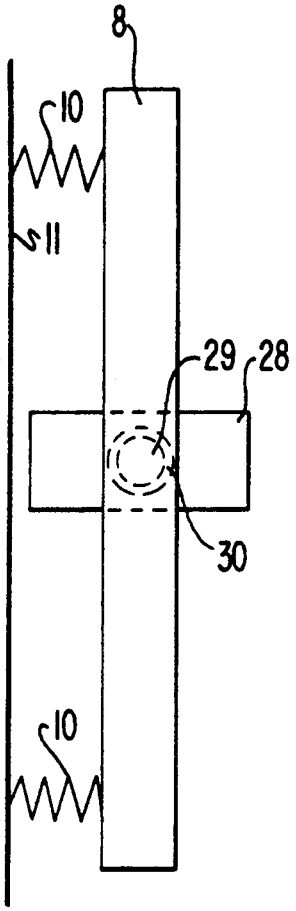
FIG. 6 is a top view of the rear tensioning rail and the rubber guide permitting it to be pivoted.
Figure 7:
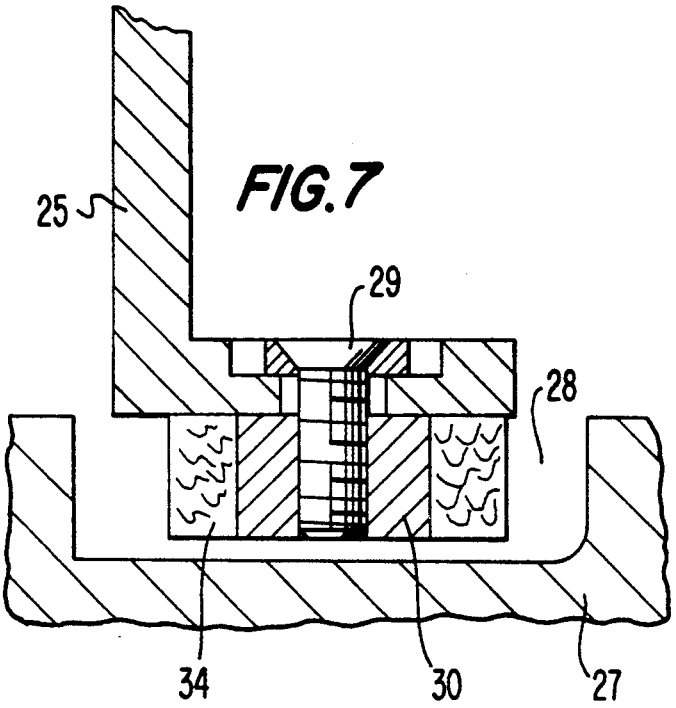
FIG. 7 is an enlarged axial sectional view of FIG. 6 including the rubber guide.
Figure 8:
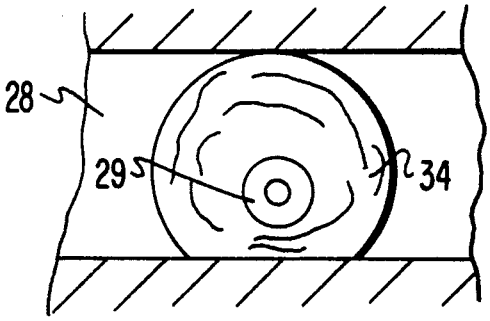
FIG. 8 is a plan view of FIG. 7.

FIGS. 6 to 8 show a rubber guide which serves to compensate for the pivoting or canting of rear tensioning rail 8 and also for centering it.

For this purpose, a recess 28 extending in the circumferential direction is provided in the trough of cylinder 27, with the shank of a guide screw 29 engaging in recess 28. The screw is screwed to the rear tensioning rail or its base rail 25, respectively. A nut 30 is screwed onto the shank of screw 29 and a cylindrical rubber body 34 is vulcanized onto this shank.

FIG. 8 shows that rubber body 34 lies against the side wall of guide recess 28 and is there compressed more strongly. This corresponds to situation 8*c* in FIG. 2 where rear tensioning rail 8 is shown in a canted position.

Before tensioning rail 8 is placed into an oblique position it is important that, for displacement at the start-of-printing location about a certain path, springs 10 at rear tensioning rail 8 are slightly relaxed, namely by an amount that is slightly more than the displacement at forward tensioning rail 7.

Figure 9:
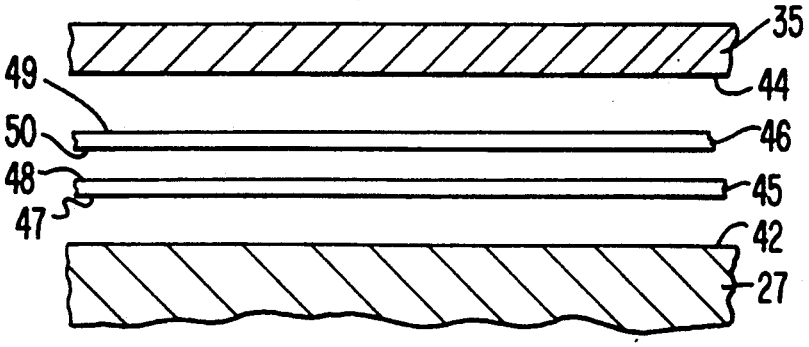
FIG. 9 is a developed sectional view in a drawn-apart illustration of a plate cylinder including thin sheets which reduce sliding friction.

Between plate cylinder 27 and printing plate 35 there is preferably provided an arrangement of thin sheets shown in FIG. 9 in order to reduce the friction between these components. This sheet arrangement is composed of at least two superposed thin sheets 45 and 46, each of which has a side which slides particularly well, that is, has a low coefficient of sliding friction. Both thin sheets lie against one another with their faces having the low coefficient of sliding friction and their other faces, that is, the faces having the higher coefficient of sliding friction, lie against the upper face of plate cylinder 27 and the underside of printing plate 35, respectively. This noticeably reduces the sliding friction between plate cylinder 27 and printing plate 35.

In detail, underside 47 of lower sheet 45 has a greater roughness than its upper face 48. Correspondingly, upper face 49 of upper sheet 46 has a greater roughness than underside 50 of upper sheet 46. In other words, mutually facing and contacting sides 48 and 50 of sheets 45 and 46 slide easily while sides 47 and 49 which face away from one another are noticeably rougher. Faces 42 and 44 of plate cylinder 27 and printing plate 35, respectively, also have a noticeable roughness.

In operation, the layers lie closely above one another and printing plate 35 with its contacting upper sheet 46 is able to move easily relative to plate cylinder 27 and lower sheet 45 contacting it.

For example, rougher sides 47 and/or 49 are selfadhesive so that at least one of thin sheets 45, 46 adheres to plate cylinder 27 or printing plate 35, respectively.

Easily sliding faces 48, 50 are preferably realized by an appropriate plastic coating on sheets 45 and 46.

An additional thin sheet or sheets may possibly be disposed between faces 42, 47 and/or 44, 49, if required. Therefore, thin sheets having the characteristics of the invention and/or conventional thin sheets may be additionally provided.

FIG. 1 also shows that forward and rearward tensioning rails 7 and 8 are provided with center guides 51 as described above with reference to FIGS. 6 to 8 for rear tensioning rail 8. However, the central guide of forward tensioning rail 7 does not require rubber body 34.

The spring tension of forward springs 12 is greater than that of rear springs 10.

The invention has been described in detail with respect to preferred embodiments, and it will now be apparent from the foregoing to those skilled in the art that changes and modifications may be made without departing from the invention in its broader aspects, and it is the intention, therefore, in the appended claims to cover all such changes and modifications as may fall within the true spirit of the invention.

What is claimed is:

1. An apparatus for a printing press to correct a registration error in a printed image by displacing a printing plate on a plate cylinder, comprising:

a plate cylinder having a trough with a central region extending axially along the circumference of said plate cylinder and said plate cylinder having a start-of-printing location and an end-of-printing location;

a printing plate lying against the circumference of said plate cylinder;

a forward tensioning rail having a first end and a second end and a rearward tensioning rail disposed in said trough and connected with said printing plate at the start-of-printing location and the end-of-printing location, respectively;

tensioning means, including spring means, for applying spring forces against each said rail toward the central region of said trough for tensioning said printing plate at the start-of-printing and the end-of-printing locations of said plate cylinder, respectively;

first adjustment means provided between said forward and rearward tensioning rails for adjustably displacing said forward tensioning rail in the circumferential direction of said plate cylinder away from the central region of said trough against respective spring forces, said first adjustment means having a first displacement means for adjusting the first end of said forward tensioning rail and a second displacement means for adjusting the second end of said forward tensioning rail, said first and second displacement means being independently operable;

second adjustment means provided between said forward and rearward tensioning rails for displacing said rearward tensioning rail away from the central region against respective spring forces and for adjusting said rearward tensioning rail in a direction parallel to itself.

2. The apparatus according to claim 1, wherein said trough has a rearward trough wall and a forward trough wall; and said spring means includes a first pair of springs between said rearward trough wall and said rearward tensioning rail and a second pair of springs between said forward trough wall and said forward tensioning rail.

3. The apparatus according to claim 7, further comprising:

at least two thin sheets disposed between said plate cylinder and said printing plate, each of said thin sheets having opposite faces with one face of each sheet having a lower coefficient of sliding friction than the other face of the same sheet, wherein, said one face of each sheet lie one against the other.

4. The apparatus according to claim 3, wherein each of said thin sheets have a plastic coating on said one face.

5. The apparatus according to claim 7, further comprising:

guide means connected to said rearward tensioning rail and cooperating with said plate cylinder for guiding said rearward tensioning rail in its displacement direction, said guide means including a rubber elastic element for permitting displacement of said rearward tensioning rail in the axial direction of said plate cylinder.

6. A plate cylinder according to claim 5, wherein:

said plate cylinder includes a guide recess in said trough; and said guide means includes a guide screw screwed into said rearward tensioning rail, said guide screw having a shank which is guided in said guide recess and a rubber elastic element being disposed on said shank.

* * * * *